US007066354B2

(12) United States Patent
Stank et al.

(10) Patent No.: US 7,066,354 B2
(45) Date of Patent: Jun. 27, 2006

(54) MIXING AND DISPENSING APPARATUS

(76) Inventors: Robert E. Stank, 82 Mt. Heights Dr., Sparta, NJ (US) 07871; Arthur L. Vellutato, Sr., 115 Lori Cir., Exton, PA (US) 19341

( * ) Notice: Subject to any disclaimer, the term of this patent is extended or adjusted under 35 U.S.C. 154(b) by 0 days.

(21) Appl. No.: 10/755,675

(22) Filed: Jan. 13, 2004

(65) Prior Publication Data

US 2004/0238566 A1 Dec. 2, 2004

Related U.S. Application Data

(63) Continuation-in-part of application No. 10/346,169, filed on Jan. 17, 2003, now Pat. No. 6,851,580, and a continuation-in-part of application No. 10/754,629, filed on Jan. 12, 2004.

(51) Int. Cl.
*B67D 5/56* (2006.01)

(52) U.S. Cl. ..... 222/129; 222/525; 206/221

(58) Field of Classification Search ..... 222/129, 222/130, 145.1, 145.5, 522–525; 206/219, 206/221, 222
See application file for complete search history.

(56) References Cited

U.S. PATENT DOCUMENTS

| | | | | |
|---|---|---|---|---|
| 2,781,141 | A | 2/1957 | Luden | 215/6 |
| 3,156,369 | A | 11/1964 | Bowes et al. | 215/6 |
| 3,326,400 | A | 6/1967 | Hamelin et al. | 215/6 |
| 3,347,410 | A | 10/1967 | Schwartzman | 222/80 |
| 3,458,076 | A | 7/1969 | Babcock | 215/6 |
| 3,856,138 | A | 12/1974 | Maekawa et al. | 206/221 |
| 3,966,089 | A | 6/1976 | Klingaman | 222/88 |
| 3,968,872 | A | 7/1976 | Cavazza | 206/222 |
| 4,177,938 | A | 12/1979 | Brina | 222/80 |
| 4,195,730 | A | 4/1980 | Hunt | 206/221 |
| 4,195,731 | A | 4/1980 | Cavazza | 206/222 |
| 4,221,291 | A | 9/1980 | Hunt | 206/222 |
| 4,264,007 | A | 4/1981 | Hunt | 206/219 |
| 4,591,050 | A | 5/1986 | Finke et al. | 206/222 |
| 4,615,437 | A | 10/1986 | Finke et al. | 206/222 |
| 4,757,916 | A | 7/1988 | Goncalves | 222/83 |
| 4,793,475 | A | 12/1988 | Itzel | 206/221 |
| 4,903,865 | A | 2/1990 | Janowitz | 222/83.5 |
| 4,982,875 | A | 1/1991 | Pozzi et al. | 222/83 |
| 5,029,718 | A | 7/1991 | Rizzardi | 215/254 |
| 5,038,951 | A | 8/1991 | Rizzardi | 215/256 |
| 5,114,011 | A | 5/1992 | Robbins, III | 206/499 |
| 5,215,225 | A | 6/1993 | Kopp | 222/129 |

(Continued)

FOREIGN PATENT DOCUMENTS

| | | |
|---|---|---|
| DE | 460 043 | 5/1928 |

(Continued)

*Primary Examiner*—Joseph A. Kaufman
(74) *Attorney, Agent, or Firm*—Blank Rome LLP

(57) ABSTRACT

A mixing and dispensing apparatus has a small bottle which is positioned within a larger bottle. The small bottle contains a concentrated solution, and the larger bottle contains water. The small bottle has a nozzle that is off-center, a grip base that is an integral part of the bottle, and a vent to maintain zero atmospheric pressure internally. The small bottle is inverted and placed within the neck of the large bottle. The nozzle of the small bottle is placed within a narrowed internal passageway at the base of the neck of the nozzle. Once the apparatus is ready for use, the small bottle is pulled upward using a pull ring, thereby opening the nozzle and releasing the contents of the small bottle into the large bottle. The contents are poured out through a separate pour spout.

20 Claims, 8 Drawing Sheets

U.S. PATENT DOCUMENTS

| | | | | |
|---|---|---|---|---|
| 5,383,579 | A | 1/1995 | Lanfranconi et al. | 222/129 |
| 5,421,483 | A | 6/1995 | Parise | 222/82 |
| 5,543,097 | A | 8/1996 | Fang | 264/102 |
| 5,613,623 | A | 3/1997 | Hildebrandt | 222/129 |
| 5,772,017 | A | 6/1998 | Kang | 206/222 |
| 5,811,060 | A | 9/1998 | Laguna Valderrama | 206/222 |
| 5,860,569 | A | 1/1999 | Gregoire | 222/129 |
| 5,875,889 | A | 3/1999 | Albisetti | 206/221 |
| 5,941,380 | A | 8/1999 | Rothman | 206/222 |
| 5,950,819 | A | 9/1999 | Sellars | 206/221 |
| 6,022,134 | A | 2/2000 | Andrews | 366/130 |
| 6,041,969 | A | 3/2000 | Parise | 222/129 |
| 6,073,803 | A | 6/2000 | Sturm et al. | 222/80 |
| 6,152,296 | A | 11/2000 | Shih | 206/222 |
| 6,305,576 | B1 | 10/2001 | Leoncavallo | 222/83.5 |
| 6,851,580 | B1 * | 2/2005 | Stank et al. | 222/129 |

FOREIGN PATENT DOCUMENTS

| | | |
|---|---|---|
| DE | 20022904 | 8/2002 |
| FR | 2707601 | 1/1991 |
| WO | WO 02/085 775 | 4/2002 |

* cited by examiner

MIXING AND DISPENSING APPARATUS

RELATED APPLICATIONS

The present application is a continuation-in-part of U.S. Ser. No. 10/346,169, filed Jan. 17, 2003, now U.S. Pat. No. 6,851,580, and U.S. Serial No. 10/754,629, filed Jan. 12, 2004.

BACKGROUND OF THE INVENTION

1. Field of the Invention

The present invention relates to an apparatus for storing and shipping a composition. More particularly, the present invention relates to an apparatus which separately stores two substances, mixes the two substances when ready to be used, and dispenses the mixed substances.

2. Background of the Related Art

A number of containers have been developed which separately store two substances, and allow the two substances to be mixed together prior to being dispensed. One technique for mixing the substances is shown, for instance, in U.S. Pat. Nos. 6,305,576 to Leoncavallo, 6,152,296 to Shih, and 6,073,803 to Sturm et al. These patents generally store the substances in separate containers, then break or puncture one of the containers to permit the substance stored therein to mix with the substance being stored in the other container.

These containers, however, are not reusable since one of the containers is punctured. In addition, a sharp implement is required to puncture one of the containers, which can be hazardous to the user. The containers also require careful placement of the containers, can be difficult to fill, and awkward to mix and dispense the substances.

SUMMARY OF THE INVENTION

Accordingly, it is an object of the invention to provide a mixing and dispensing apparatus. It is another object of the invention to provide a mixing and dispensing apparatus which is easy to manufacture and use. It is yet another object of the present invention to provide a mixing and dispensing apparatus which does not have sharp implements or require puncturing of a container.

The mixing and dispensing apparatus is essentially a small bottle which is positioned within a larger bottle. The small bottle contains a concentrated solution, and the larger bottle contains water. The small bottle has a nozzle that is off-center, a grip base that is an integral part of the bottle, and a vent to maintain zero atmospheric pressure internally. The small bottle is inverted and placed within the neck of the large bottle. The small bottle is then rotated so that the neck of the nozzle comes between two arms of a release mechanism which is an integral part of the large bottle. The combined bottles are then sent to the customer and the contents of the bottles remain separate.

Once the customer is ready to use the contents of the bottles, the cap of the large bottle is opened. The small bottle is pulled upward using the grip base or a ring pull, causing the release mechanism to engage the lip of the nozzle, thereby opening the nozzle and releasing the contents of the small bottle into the large bottle. The vent of the small bottle releases any internal pressure in the small bottle, and breaks any vapor lock so the contents can readily flow out of the small bottle. The user shakes the bottle to combine the materials, and then can pour the contents out through the space between the small bottle and the neck of the large bottle. Alternatively, the contents can be poured out through a pour spout located on the side of the larger bottle.

These and other objects of the invention, as well as many of the intended advantages thereof, will become more readily apparent when reference is made to the following description, taken in conjunction with the accompanying drawings.

DETAILED DESCRIPTION OF THE PREFERRED EMBODIMENTS

Figure 1:
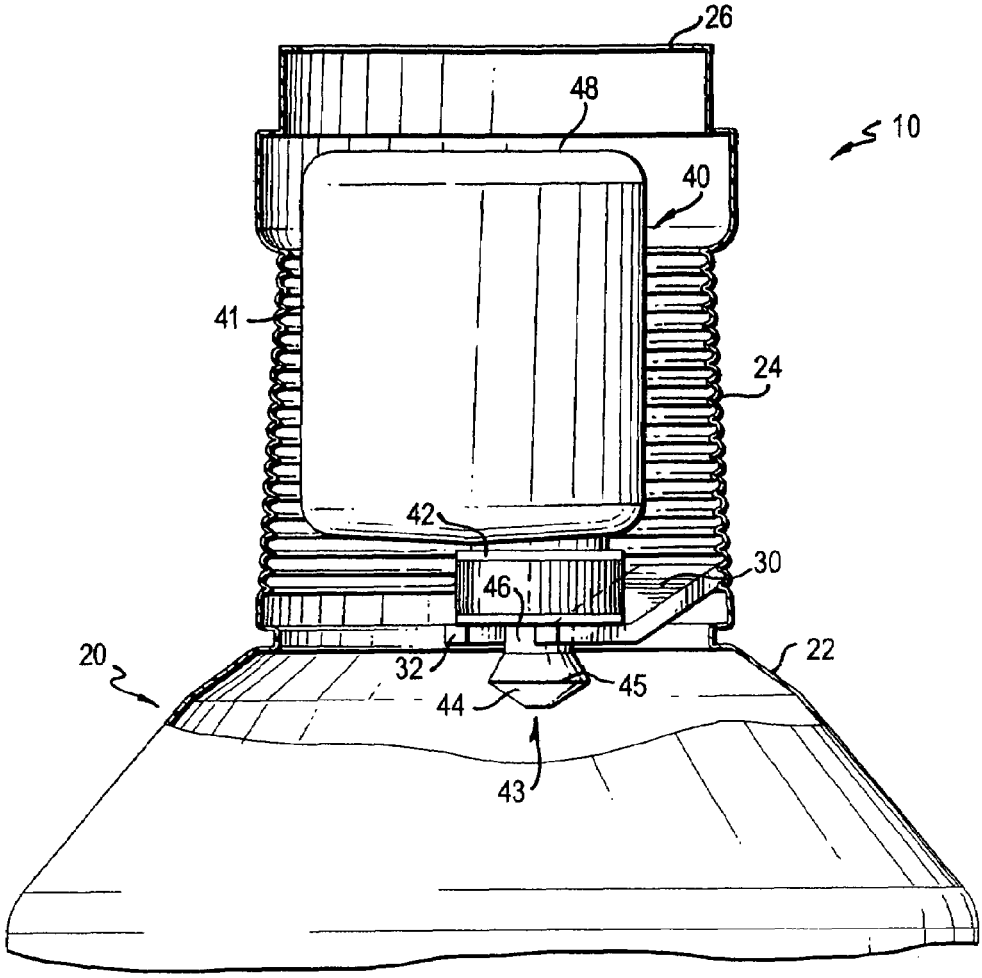
FIG. 1 shows the mixing and dispensing system in accordance with the preferred embodiment of the invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose.

Turning to the drawings, FIG. 1 shows the mixing and dispensing apparatus 10 in accordance with the preferred embodiment of the invention. The apparatus 10 has two primary elements: a first large container 20, and a second small container 40. The large container 20 and the small container 40 are both preferably round plastic bottles, and are sized so that the small container 40 can be positioned inside the large container 20.

The large bottle 20 has a body section 22, a neck 24, and an opening 26 at the top of the large bottle 20. The large bottle 20 is used to retain a first substance, preferably water, as well as the small bottle 40. The neck 24 receives the second bottle 40, and the opening 26 permits the contents of the large bottle 20 to be received and dispensed. In accordance with the preferred embodiment of the invention, the large bottle 20 is about 14.5 inches in height, about 7.375 inches in diameter, and can hold about 5 quarts of liquid. The neck 24 of the large bottle 20 has a diameter of about 70 mm.

A ramp or release mechanism 30 is located in the neck 24 of the large bottle 20. The release mechanism 30 is preferably integral with the neck 24 of the large bottle 20, but can also be a separate element which engages the neck 24 of the bottle 20. The release mechanism 30 has a forked end with two prongs or arms 32. The release mechanism 30 is plastic, and extends inward to about the center of the neck 24. The release mechanism 30 can be sloped downward to provide added support against the pulling of the small bottle 40. As shown, one end of the release mechanism 30 is molded integral with the bottle, and the arms 32 terminate at about the center of the neck 24 of the large bottle 20. The release mechanism 30 supports the entire weight of the small bottle 40, preferably up to about 250 grams.

The small bottle 40 also has a body section 41, and a neck 42. In addition, the small bottle 40 has a nozzle 43, and an integral base grip 48. The small bottle 40 retains a second substance, preferably a concentrated liquid solution. The nozzle 43 has a nozzle cap 44 which has a top section, a tapered neck 46, and a ledge 45 formed therebetween. The nozzle 43 is preferably opened and closed by respectively pushing and pulling on the nozzle cap 44. When the nozzle cap 44 is pulled out, the nozzle 43 is opened, and the contents of the small bottle 40 can be released. When the nozzle cap 44 is pushed in, the nozzle 43 is closed, and the contents of the small bottle 40 are sealed in the bottle 40. The ledge 45 extends around the entire nozzle cap 44.

The neck 42 and the nozzle 43 of the small bottle 40 are off-centered with respect to the body section 41. Accordingly, the small bottle 40 can be placed inside the neck 24 of the large bottle 20, along the side of the neck 24 opposition the release mechanism 30, so that the nozzle cap 44 is located outside of the prongs 32. The base grip 48 allows the user to grip the small bottle 40 and to turn the small bottle 40 as it is positioned inside the large bottle 20.

Figure 2:
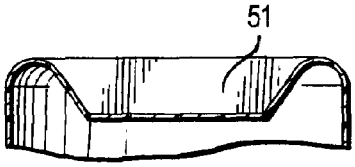
FIG. 2 is a side view of the bottom of the small container having a base grip.
Figure 3:
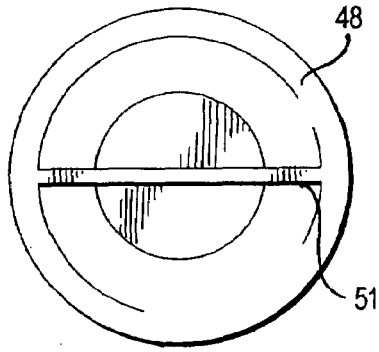
FIG. 3 is a top view of the base grip of the small container.

FIGS. 2 and 3 show the bottom of the small bottle 40 in further detail. The bottom of the small bottle 40 is depressed inward to form a depressed section 51. The base grip 48 projects upward from the depressed section 51. The base grip 48, however, does not extend beyond the bottom of the small bottle 40, so that it can be readily accessed by the user and the small bottle 40 can be turned by the user.

When the small bottle 40 is rotated, the neck portion 46 of the nozzle cap 44 of the small bottle 40 moves into a position between the prongs 32 of the release mechanism 30, as shown in FIG. 1. The base grip 48 is used to position the small bottle 40 within the large bottle 20, and to pull the small bottle 40 upwards when it is positioned within the prongs 32 of release mechanism 30. When the small bottle 40 is pulled outward, the prongs 32 grip the ledge 45 of the nozzle cap 44, which in turn pulls the nozzle cap 44 outward to open the nozzle 43.

The small bottle 40 is preferably about 2.5 inches in diameter, and about 4.5 inches in height, and can retain approximately 8 ounces of liquid. A vent is provided to maintain zero atmospheric pressure internal to the small bottle 40. The large bottle 20 and small bottle 40 are preferably made of plastic, such as polyethylene. The nozzle cap 44 is preferably a vented cap with a retention liner. The retention liner allows air to pass out of the bottle, without allowing any liquid to escape.

In operation, the large bottle 20 is filled with the first substance through the opening 26. The small bottle 40 is filled with the second substance by unscrewing the nozzle 43 at the neck 42 of the small bottle 40. The nozzle 43 is then fitted back onto the small bottle 40, and pushed down to close the nozzle 43. The small bottle 40 is then inverted and placed within the neck 24 of the large bottle 20, so that the nozzle 43 is outside the arms 32 of the release mechanism 30. The base grip 48 of the small bottle 40 is then used to rotate the small bottle 40 so that the nozzle cap 44 is positioned between the two arms 32 of the release mechanism 30. A cap is placed on the large bottle 20, and the combined bottles 20, 40 are shipped to a customer. The contents of the bottles 20, 40 remain separate until it is ready for use by the customer.

Once the customer is ready to use the contents of the bottles 20, 40, the cap of the large bottle 20 is opened. The small bottle 40 is pulled upward using the base grip 48. As the small bottle 40 is pulled upward, the nozzle cap 44 is opened by the force of the arms 32 of the fixed release mechanism 30 against the ledge 45 of the nozzle cap 44. The force causes the release mechanism 30 to open the nozzle 43 on the small bottle 40, thereby releasing the contents of the small bottle 40 into the large bottle 20.

The vented cap 44 of the small bottle 40 releases any internal pressure in the small bottle 40, and breaks any vapor lock so the nozzle 43 is easy to open and so that the contents can readily flow out of the small bottle 40 into the large bottle 20. The user can replace the cap on the large bottle 20, and shake the bottle 20 to further combine the materials. The contents can then be poured out of the large bottle 20 through the space between the small bottle 40 and the neck 24 of the large bottle 20.

Figure 4:
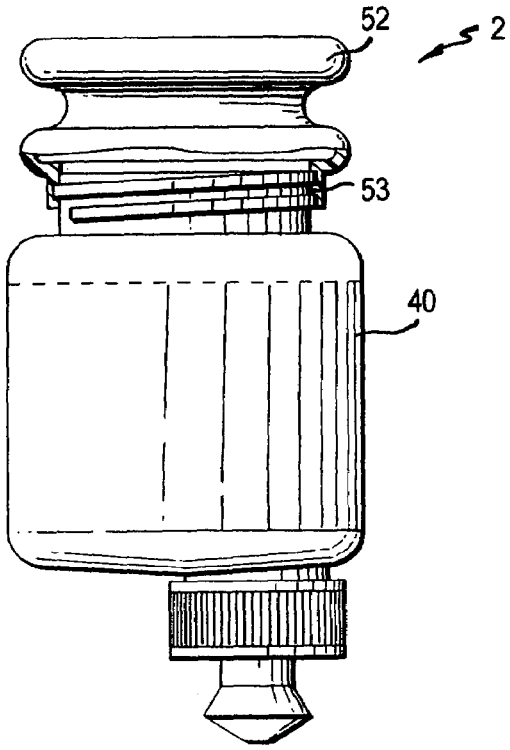
FIG. 4 shows the small container having a spin dome in accordance with an alternative embodiment of the invention.
Figure 5:
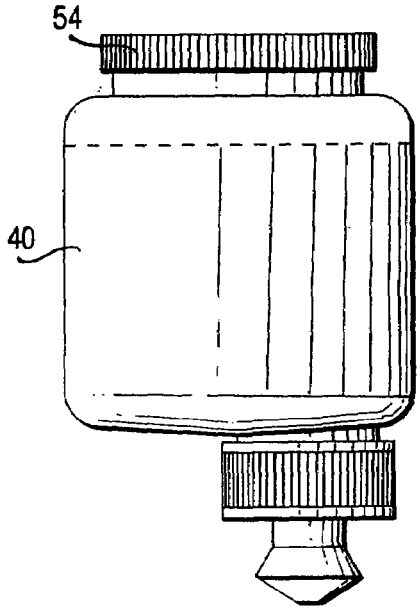
FIG. 5 shows the small container of FIG. 4 with a cap.
Figure 6:
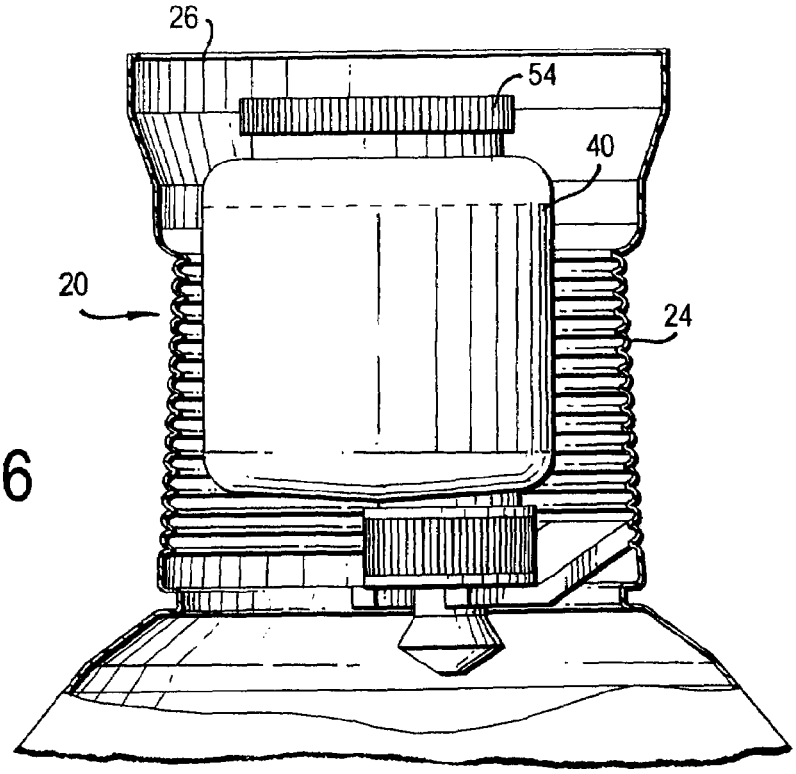
FIG. 6 shows the large container with a wide mouth.

Turning to FIGS. 4–6, alternative embodiments of the invention are shown. In FIG. 4, a spin dome 52 is positioned over the bottom of the small bottle 40, as an alternative means to assisting the user in turning the small bottle 40 so that the neck 42 of the bottle 40 comes between the arms 32 of the release mechanism 30. The spin dome 52 can also be used to pull up on the bottle 40 to open the nozzle cap 44. The small bottle 40 has a tapered bottom section 53 which is threaded. The spin dome 52 can be screwed onto the threaded bottom section 53 during manufacture.

FIGS. 4 and 5 shows an alternative configuration for the small bottle 40, in which the bottom of the bottle 40 projects outward so that the cap 54 is easily accessible by the user. The cap 54 preferably has ridges along the outer edge of the cap 54, so that the user can easily grip the cap 54 and rotate and pull the bottle 40.

As shown in FIG. 6, the first bottle 20 can have a wide-mouth opening 26 which expands outward as it progresses upward from the neck 24 of the bottle 20. The wide mouth facilitates placement of the small bottle 40 in the neck 24 of the large bottle 20, as well as dispensing of the mixed first and second substances. The wide mouth also makes it easier for the user to grip the cap 54 and/or the sides of the small bottle 40. The cap 54 can be opened slightly to allow air to enter and facilitate the release of the contents of the small bottle 40 into the large bottle 20.

The present invention is made of plastic, which can be recycled. The apparatus 10 does not require the use of any sharp materials, and the small container 40 need not be pierced to release its contents into the large container 20. In addition, the apparatus 10 does not require any elements to be broken or removed. Accordingly, the apparatus 10 can be reused simply by re-filling the first and second container 20, 40.

Figure 7:
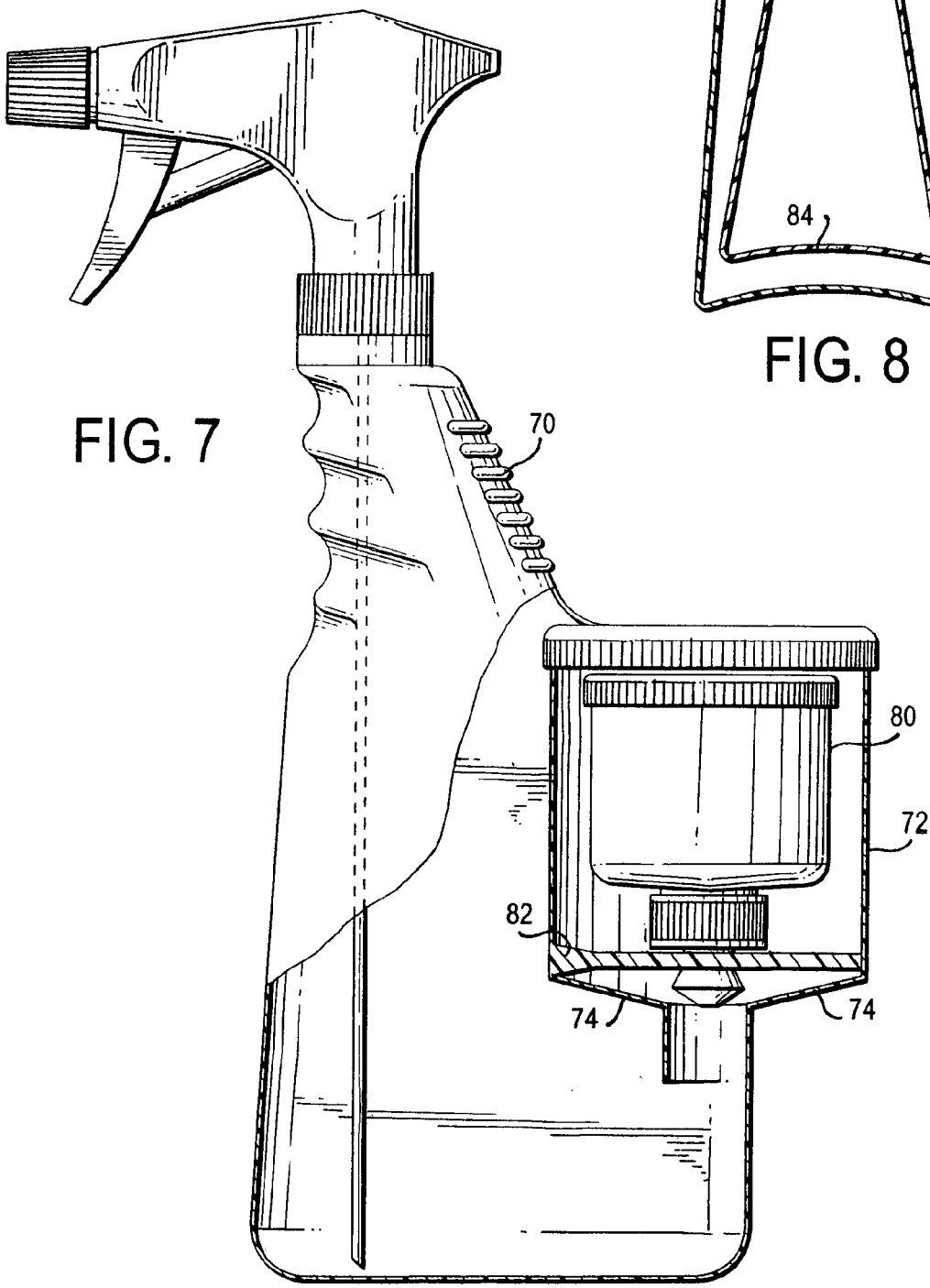
FIG. 7 shows the mixing and dispensing system for a spray bottle in accordance with an another preferred embodiment of the invention.

Another preferred embodiment of the invention is shown in FIG. 7, in which the large bottle 70 is a spray bottle. Here, the large bottle 70 has a receiving portion 72 molded integral to the body of the bottle 70. The receiving portion 72 is generally shaped as a circular container with a tapered bottom 74 section which leads into the large bottle 70. A small bottle 80 is received in the large bottle 70, as with the apparatus 10 of FIG. 1. The receiving portion 72 has a vented cap, which allows access to the receiving portion 72.

A release mechanism 82 is positioned within the receiving portion 72 to engage the nozzle of the small bottle 80. The release mechanism 82 preferably extends across the receiving portion 72, and is supported by the tapered bottom 74 of the receiving portion 72. The release mechanism 82 is integrally molded with the receiving portion 72 of the large bottle 70. Preferably, only the base 84 of the release mechanism 84 (FIG. 8) is molded with the large bottle 70.

Figure 8:
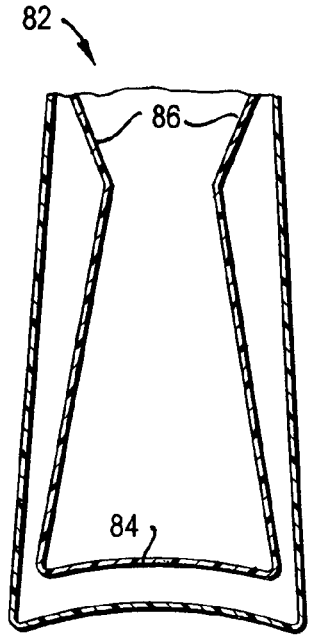
FIG. 8 shows a release mechanism for use with the mixing and dispensing system of FIG. 7.

As shown in further detail in FIG. 8, the release mechanism 82 is a U-shaped member having a base 84 and two arms 86. Unlike the embodiment of FIG. 1, in which the small bottle 40 is turned to engage the arms 32 of the release mechanism 30, the small bottle 80 of the present embodiment is simple pushed into position between the arms 86 of the release mechanism 82. Thus, the arms 86 of the release mechanism 82 are sufficiently flexible so that they separate to allow the nozzle of the small bottle 80 to be pushed between the arms 86, and return to their original position after the bottle is in place. At the same time, the arms 86 are sufficiently rigid so that the nozzle does not pull out from between the arms 86 when the user pulls upward on the small bottle 80. It should be recognized that any suitable alternative to arms can be used, such as providing an opening in the release mechanism.

Figure 9:
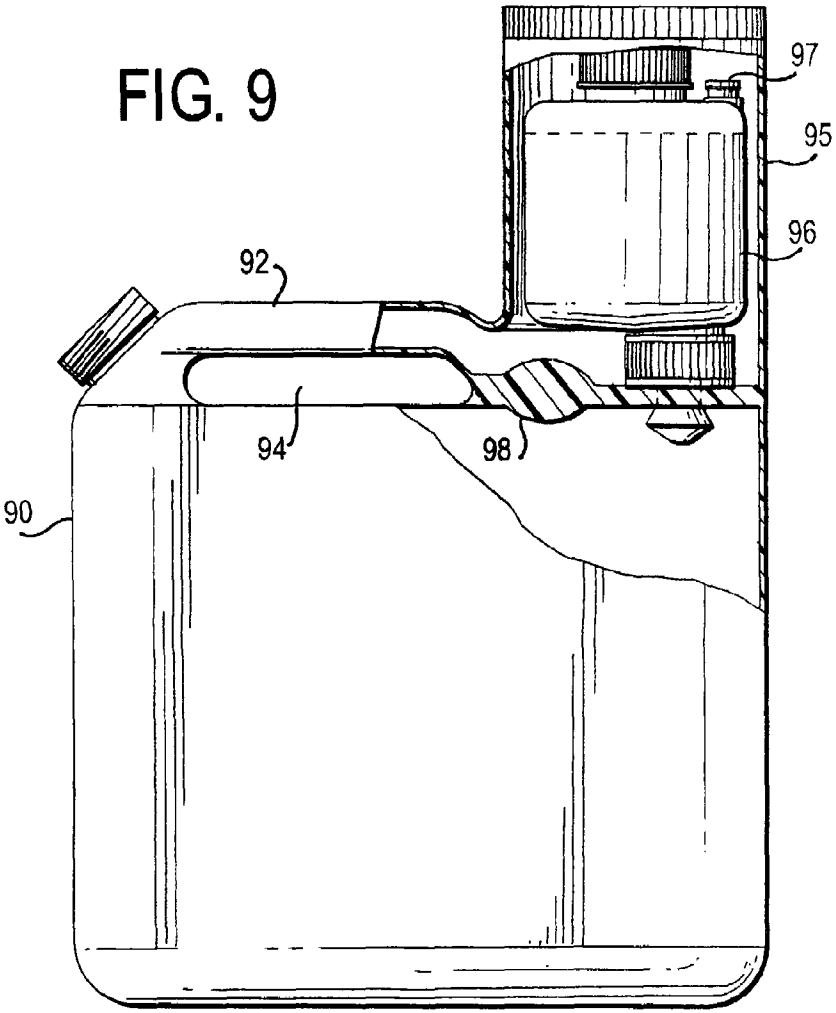
FIG. 9 shows the mixing and dispensing system for a large container in accordance with another preferred embodiment of the invention.

Turning next to FIG. 9, another preferred embodiment of the invention is shown. Here, the large bottle 90 has an internal passageway 92 formed by an opening 94 in the large bottle. The passageway 92 forms a handle for the large bottle 90. A release mechanism 98 is integrally molded with the large bottle 90, and preferably only the base of the release mechanism 98 is integrally molded. The release mechanism 98 extends from one end of the handle 92 at the end of the opening 94. The large bottle 90 has an integral receiving portion 95 which receives the small bottle 96. The small bottle 96 has a vent 97 with a plug. The vent 97 can release air, and the plug can be removed to permit liquid to better flow out of the small bottle 96. The release mechanism 98 is similar to the release mechanism 80 shown in FIG. 8.

In the embodiment of FIG. 7, the large bottle 70 can retain from about 8–32 ounces of fluid, and the small bottle 80 can retain about 0.5–2 ounces of fluid. In FIG. 9, the small bottle 96 retains up to about 32 ounces of liquid, and the large bottle 90 retains up to about four gallons of liquid.

Figure 10:
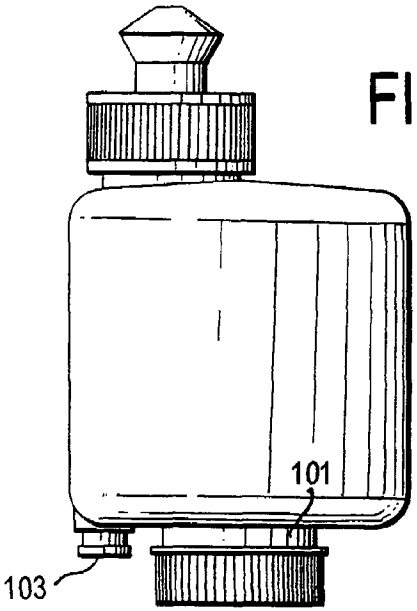
FIG. 10 shows the small bottle.

FIG. 10 shows the small bottle 80, 96 used in the embodiments of FIGS. 7 and 9, respectively. Similar to the bottle 54 shown in FIG. 5, the small bottle 80, 96 has a collar 101 which projects outward from the bottom surface of the bottle. A vent or opening 103 is located on the bottom of the bottle. A cap having a vented liner is placed over the collar to allow the bottle to vent gas without allowing liquid to escape. As shown in each of FIGS. 7, 9 and 10, the neck of the small bottle is off-center. This is due to the confined space and positioning of the receiving portion 72, 95. It should be recognized, however, that the receiving portion 72, 95 can be placed at any suitable position, and the neck of the small bottle 80, 96 can be centered.

Figure 11:
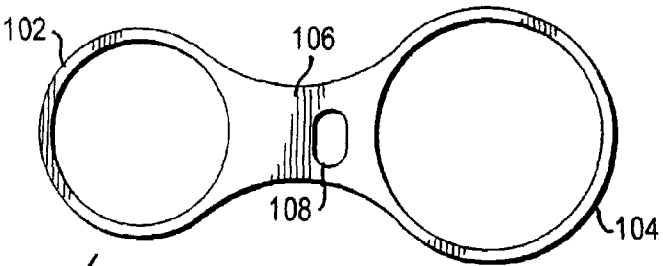
FIG. 11 shows a ring pull device for use with the small bottle.

Referring to FIG. 11, a pull 100 is provided for use with the small bottle of FIG. 10. The pull 100 has two rings 102, 104 connected by a mid-section 106. The larger ring 104 is placed about the collar 101, and the cap is then placed on the bottle. The mid-section 106 has a plug or stopper 108, which can be made of rubber or any other suitable material. After the larger ring 104 is placed around the collar 101, the stopper 108 is pushed into the opening 103 on the bottle.

After the cap is placed on the collar 101, the pull 100 is folded at the mid-section 106, so that the smaller ring 102 is positioned on top of the cap where it can be grabbed by a user. The smaller ring 102 is a finger grip which the user can pull on to pull the small bottle, which presses against the lip on the cap, thereby opening the nozzle of the small bottle. The pulling action also causes the stopper 108 to withdraw from the opening 103 in the small bottle, to permit liquid to more easily dispense from the small bottle into the large bottle.

Figure 12:
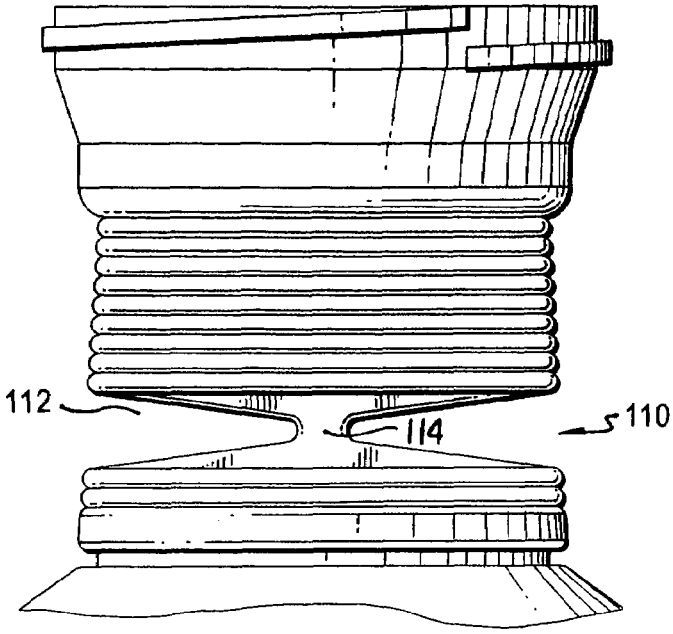
FIG. 12 shows the large bottle in accordance with another preferred embodiment of the invention.

Turning next to FIG. 12, another preferred embodiment of the invention is shown. As shown, the neck of a large bottle has two depressed V-shaped depressions 110, 112 which form a narrowed passageway 114 therebetween. The small bottle (not shown) can be placed in the neck of the large bottle, and the nozzle of the small bottle pushed into the passageway 114. The nozzle of the small bottle can then be opened by pulling up on the small bottle, so that the bottom surface of the depressions 110, 112 cooperate with the ledge of the nozzle to open the nozzle. Accordingly, this embodiment eliminates the need for a separate release mechanism. The channels 110, 112 also form an internal top surface which supports the bottle.

In accordance with the preferred embodiment shown in FIG. 12, the depressions 110, 112 are channels which extend all the way through the neck of the bottle. Accordingly, the channel depressions create an internal passageway 114 which extends from one side of the bottle to the other. However, the depressions 110, 112, need not extend the entire width of the bottle, but instead can have a flattened conical shape, as if created by pressing a tapered flat pencil into the bottle so that the passageway 114 is formed by two ledges within the bottle. Alternatively, the depression 110 can extend the entire circumference of the bottle, so that the passageway 114 forms a circle at substantially the center of the bottle.

Figure 13:
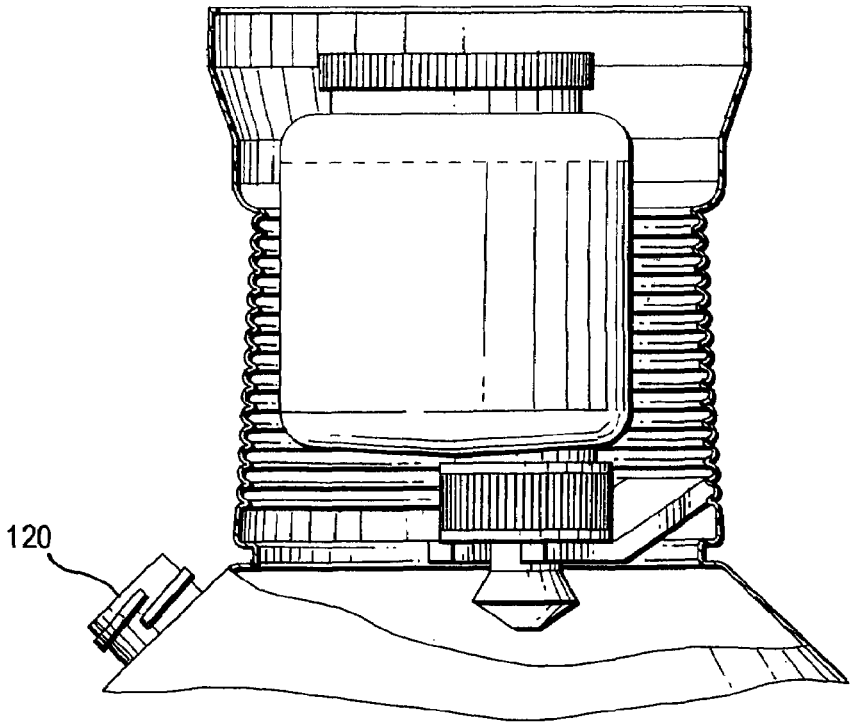
FIG. 13 shows another preferred embodiment of the invention having a separate pour spout.

FIG. 13 shows another preferred embodiment of the invention. A large bottle having a wide mouth is shown, and a pour spout 120 is provided on the side of the bottle. The pour spout 120 can be used with any of the other embodiments, such as shown in FIG. 9. The user can fill and dispense the contents of the large bottle through the pour spout 120, so that the small bottle does not obstruct the flow of the contents.

Figure 14:
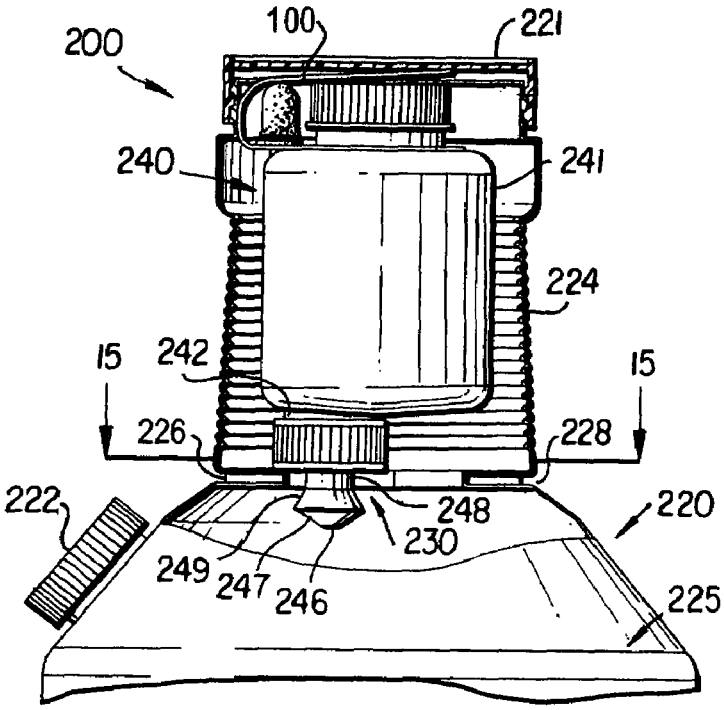
FIG. 14 is a partial side elevation view, partly in section, showing the mixing and dispensing container in accordance with a preferred embodiment of the invention.

A preferred embodiment of the invention is shown in FIGS. 14–17. Turning to FIG. 14, the apparatus 200 has two primary elements: a first large container 220, and a second small container 240. The large container 220 and the small container 240 are both preferably round plastic bottles, and are sized so that the small container 240 can be positioned inside a chamber of the large container 220. The small container has a normally closed nozzle or spout 246 at one end thereof for discharging the contents of the small container into the large container according to the method of the invention. The large container 220 has a ribbed neck 224, and an opening 223 at the top of the neck adapted to be closed by a removable cap 221, such as a threaded cap. The large container 220 is provided with a reservoir 225 that is used to retain a first substance, e.g., a diluent. The neck 224 forms a chamber that receives the second container 240, and the opening 223 permits the small container 240 to be introduced into and positioned inside the neck 224. The reservoir 225 of the large container 220 holds a predetermined amount of diluent, preferably about 1 gallon of water.

As shown, the neck 224 of large container 220 has an annular depression 226 that forms a plate or platform 238 through which passes a narrowed passageway 230 so as to provide an opening into the container reservoir 225 from the chamber of neck 224. The small container 240 is placed in the neck 224 of the large container 220 through opening 223, and the nozzle 246 of the small container is positioned in the passageway 230. The nozzle 246 of the small container 240 can then be opened by pulling upwardly on the neck 224 and small container, so that the bottom surface of the platform 238 engages a portion of the nozzle and urges the nozzle to its open position. The top surface of platform 238 supports the small container 240 in the chamber of neck 224. Flexible foam can also be positioned in the chamber about the small container 240 to stabilize it within the neck 224, especially during transportation.

Figure 15A:
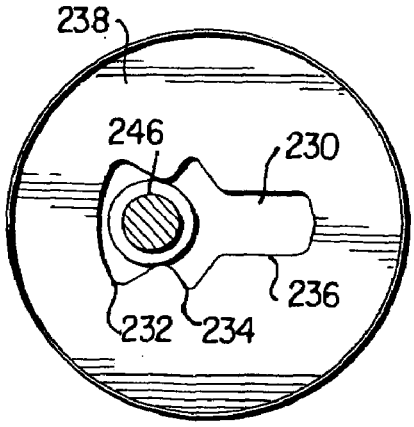
FIGS. 15(*a*) and 15(*b*) are cross-sectional views taken along line 15—15 in FIG. 14 showing an opening formed at the junction of the large and small containers used in the preferred embodiment of the invention.
Figure 15B:
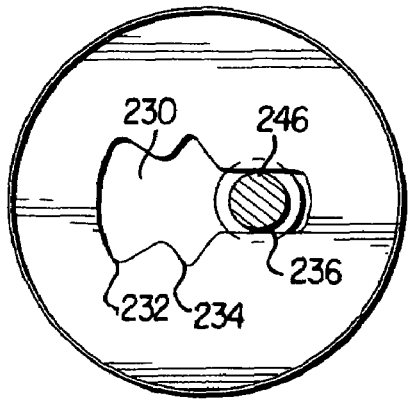

Turning to FIGS. 15(*a*) and 15(*b*), the manner in which the small container 240 engages the internal passageway 230 of the large container 220 is shown. As previously mentioned, the annular depression 226 preferably forms an internal passageway 230 in the platform 238. Passageway 230 has a generally keyhole shape with a wide portion 232, a narrow portion 236, and an intermediate portion 234 therebetween. As shown in FIG. 14, the nozzle 246 is off-centered with respect to the body 241 of the small container 240. Accordingly, the small container 240 can be placed inside the neck 224 of the large container 220 with the container 240 oriented so that the nozzle 246 is aligned with the wide portion 232 of the passageway 230.

When inserted into the chamber of the neck 224, the small container 240 is lowered so that the nozzle 246 passes into the wide portion 232 of the passageway 230, FIG. 15(*a*). At that point, the small container 240 is not rigidly fixed to the large container 220. The small container 240 is then given a quarter turn, at which point the nozzle 246 of the small container enters the mid-portion 234 of the passageway 230. The widened intermediate portion 234 operates as a transition area to give the small container 240 some stability within the passageway 230 so that the small container does not fall over within the neck of the large container 220. The small container 240 can then be straightened or flexible foam pieces may optionally be inserted around the small container to further stabilize the small container within the neck 224 of the large container 220.

The small container 240 is then rotated another quarter turn, so that the neck portion 248 of the nozzle cap 247 of the small container 240 moves into a fixed position at the narrow portion 236 of the passageway 230, where it essentially becomes locked in place, FIG. 15(*b*). When the small container 240 is pulled axially outwardly, the bottom surface of platform 238 grips shoulder 249 of the nozzle cap 247, which in turn pulls the nozzle cap outwardly to open the nozzle 246 and allow the substance in the small container 240 to dispense into the reservoir 225 of the large container 220. It should be recognized that the passageway 230 may have any suitable size and shape, such as a circular shape, an may operate by a frictionally fit with the nozzle, though the passageway 230 is preferably shaped to engage the nozzle without allowing the nozzle to fully withdraw from the large container.

The large container 220 has a pour spout 222, which is preferably located at one side thereof. Thus, the contents of the large container 220 may be dispensed through the pour spout 220 without obstruction.

As shown in FIG. 14, the small container 240 has an opening with a tapered collar 242 which projects outwardly from the bottom surface of the small container. A cover or cap 243 closes vent or opening 244 (best shown in FIG. 16) that is also located on the bottom surface of the container. The cap 243 can optionally be one that is capable of venting gas from corrosive or volatile liquids, without allowing liquid to escape. As previously described, the neck of the small container 240 is off-center to make it easier to position the nozzle 246 within the internal passageway 230. It should be understood, however, that the neck can be any suitable size, and may also be centered, i.e., aligned with the axis of the small container.

The nozzle arrangement 246 of the small container 240 is also shown in FIG. 14. The nozzle 246 has a generally frusto-conical nozzle cap 247, a cylindrical neck 248, and an annular shoulder 249 formed therebetween. The nozzle 246 is preferably opened and closed by pulling and pushing, respectively, on the nozzle cap 247. Thus, when the nozzle cap 247 is pulled axially outwardly, i.e., away from the small container, the nozzle 246 is opened and, with the container in the position shown in FIG. 14, the contents of the small container 240 are dispensed into the large container 220. When the nozzle cap 247 is pushed inwardly, i.e., toward the small container, the nozzle 246 is closed, and the contents of the small container 240 are sealed in the container 240.

The embodiment of FIG. 14 uses the pull 100 shown in FIG. 11, which is made of polypropylene or polyester, for use with the small container 240. The pull 100 has two different diameter rings 102, 104 connected by a mid-section 106. The larger ring 104 is placed about the tapered collar 242, and the cover 243 is then placed on the collar to close the container. The mid-section 106 has an opening 108 that fits over the vent 244 of the small container 240.

Figure 16:
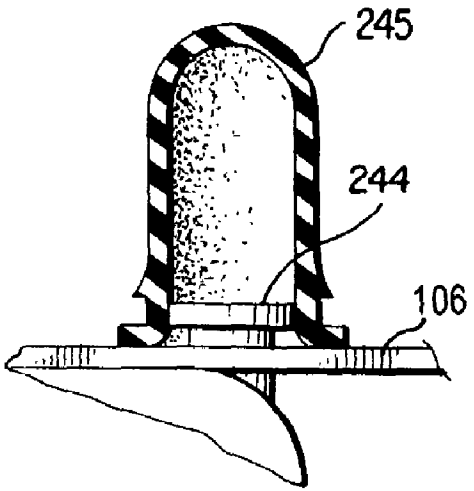
FIG. 16 is a fragmentary side elevation view, partly in section, showing a rubber cap installed on the small container of FIG. 14.

A cap or cover 245, which can be made of rubber or any other suitable material, is placed over and closes the vent 244, as best shown in FIG. 16. After the large ring 104 is placed around the collar 242, the opening 108 is fitted over the vent 244 on the container. The rubber cover 245 is then placed over the vent 244, to prevent the composition from escaping the small container. The pull 100 is then folded at the mid-section 106, so that the small ring 102 is located at the top of the cap 243 (FIG. 14). The pull 100 goes over the cover 245 so that the cover 245 will stay with the pull inside the large container 220 when it is pulled by the user. The small ring 102 is a finger grip that can be gripped and pulled by a user.

Figure 17C:
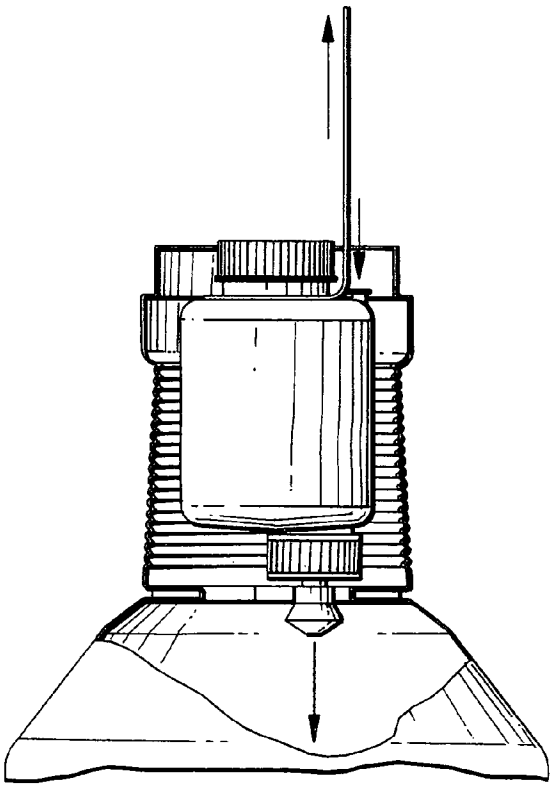
FIGS. 17(*a*)–17(*c*) are partial side elevation views, partly in section, showing the sequence of steps for releasing of the contents of the small container into the large container.
Figure 17B:
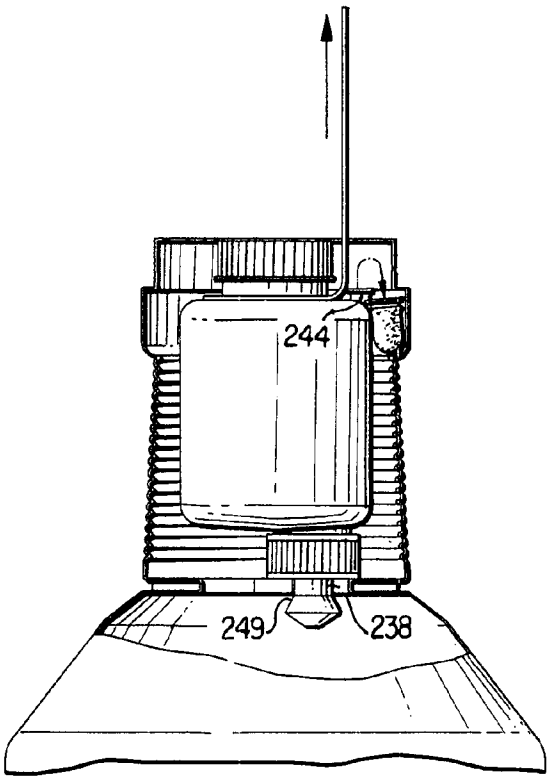
Figure 17A:
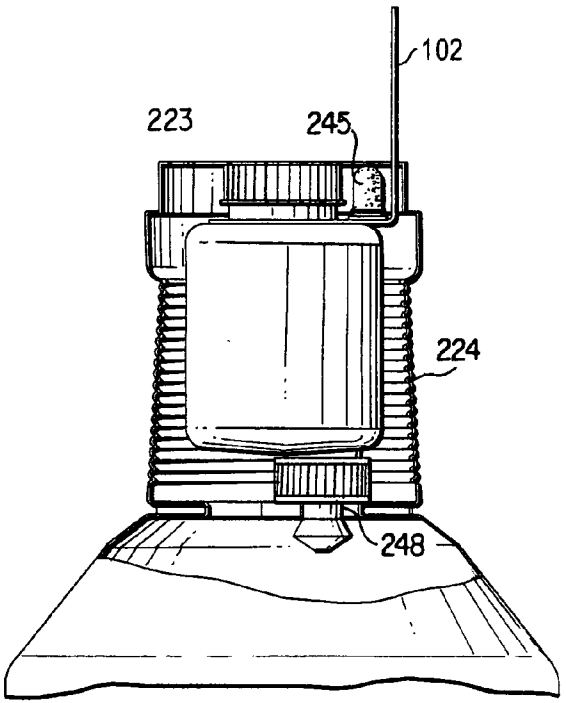

Turning to FIGS. 17(*a*)–(*c*), the operation of the pull 100 is illustrated as follows. As shown in FIG. 17(*a*), the cap 21 is removed from the large container 220, and the small ring 102 comes free of the large container. At FIG. 17(*b*), the user pulls the small ring 102 upwardly and away from the large container. The outer portion of the neck 224 is ribbed to facilitate the user gripping the container 220 and pulling on the pull 100. The pulling action causes the rubber cover 245 to be pulled off of the vent 244 in the small container. The rubber cover 245 is trapped between the pull and the cap 243 so that the cover 245 does not fall into the sterile environment. The pulling action also causes the large ring 104 to press upwardly against the lip on the cap 243 fastened to collar 242, so that the entire small container 240 is pulled upwardly. The shoulder 249 of the nozzle 246 engages the bottom surface of the platform 238, thereby urging the nozzle of the small container to its open position.

As shown in FIG. 17(*c*), the nozzle is opened, and the contents of the small container dispense into the reservoir of the large container. The vent 244 is open thereby allowing air to enter the small container and permit the concentrated composition to more easily dispense from the small container into the large container. Because the nozzle cannot pass through the narrowed portion 236 of the passageway 230, the small container stays within the neck 224 of the large container. The small ring 102 is then folded down, and the cap 221 is replaced over the opening 223 of the large container, with the small container 240 and vent cover remaining inside.

In operation, the large container and small container are filled. A first substance is placed into the reservoir 25 of the large container through the pour spout 222 or through the top of the large container. A second substance is filled into the small container through the opening in collar 42. Upon completion, and with the pull 100 and vent cover 245 in place, the opening is closed with cap 243. The small container is then placed into the neck 224 at the top of the large container and the nozzle 246 is engaged with the passageway 230 as shown in FIG. 15(*b*). The top of the large container is then closed with cap 221.

The large container 220 is filled with the first substance, the water, either through the spout 222 or the top opening 223. If the top opening 223 is used, the large container 220 is filled before the small container 240 is placed in the neck 224 as described above. The contents of the containers 220, 240 thus remain separate until the mixing and dispensing apparatus 200 is ready for use by the customer.

At this point, the user can use the contents of the containers 220, 240, as follows. The cap 221 of the large container 220 is removed and the small container 240 is pulled upward using the ring 102 of pull 100. As the small container 240 is pulled upwardly, the nozzle cap 247 is moved to the open position, and the rubber cover 245 comes off the vent 244 and stays with pull 100. The contents of the small container 240 are thereby released into the large container 220. The user then replaces the cap 221 on the large container 220, and shakes the container 220 to further combine the contents of the two containers. The thus mixed contents can then be poured out of the large container 220 through the spout 222.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

We claim:

1. A mixing and dispensing apparatus comprising:

a first container for retaining a first substance, said first container having a neck and a reservoir and a platform having a narrowed internal passageway therebetween, said platform having an internal bottom surface; and, a second container for retaining a second substance, said second container having a nozzle positioned within the internal passageway of said first container, whereby when said first container is pulled outwardly, the internal bottom surface pulls the nozzle open to release the second substance into said first container.

2. The apparatus of claim 1, wherein said first container has a pour spout for dispensing the first substance and the second substance.

3. The apparatus of claim 1, wherein said nozzle has a ledge which, when said first container is pulled outwardly, engages the internal bottom surface to open said nozzle.

4. The apparatus of claim 1, wherein said nozzle is positioned within the internal passageway by placing said second container within said first container and pushing said second container into the internal passageway.

5. The apparatus of claim 1, wherein said platform supports said second container.

6. The apparatus of claim 1, wherein the narrowed internal passageway extends inwardly with respect to a side of said neck.

7. The apparatus of claim 1, wherein said neck has a first width and said reservoir has a second width.

8. The apparatus of claim 7, wherein said first width is smaller than said second width.

9. A mixing and dispensing apparatus comprising:

a first container for retaining a first substance, said first container having a neck and a reservoir and a narrowed internal passageway therebetween having an internal bottom surface; and, a second container for retaining a second substance, said second container having a nozzle positioned within the internal passageway of said first container, whereby when said first container is pulled outwardly, the internal bottom surface pulls the nozzle open to release the second substance into said first container, said second container having a collar projecting outwardly from a bottom surface of said second container, and a lid positioned over said collar, further comprising a pull mechanism having a first ring positioned about said collar and a second ring freely positioned about said lid, wherein said first container can be raised upward by pulling on the second ring.

10. The apparatus of claim 9, wherein the first ring is connected to the second ring by a mid-section, further comprising a plug positioned at the mid-section and aligned to removably engage an opening in the bottom surface of said second container.

11. A mixing and dispensing apparatus comprising:

a first container for retaining a first substance, said first container having a neck with a side wall, a reservoir, and a passageway between said neck and said reservoir, said passageway being smaller than said neck and having a surface; and, a second container for retaining a second substance, said second container having a nozzle positioned within the passageway of said first container, whereby when said first container is pulled outwardly, the surface engages the nozzle to release the second substance into said first container.

12. The apparatus of claim 11, said second container having a collar projecting outwardly from a bottom surface of said second container, and a lid positioned over said collar, further comprising a pull mechanism having a first ring positioned about said collar and a second ring freely positioned about said lid, wherein said first container can be raised upward by pulling on the second ring.

13. The apparatus of claim 12, wherein the first ring is connected to the second ring by a mid-section, further comprising a plug positioned at the mid-section and aligned to removably engage an opening in the bottom surface of said second container.

14. The apparatus of claim 11, wherein said first container has a pour spout for dispensing the first substance and the second substance.

15. The apparatus of claim 11, wherein said nozzle has a ledge which, when said first container is pulled outwardly, engages the surface of the passageway to open said nozzle.

16. The apparatus of claim 11, wherein said nozzle is positioned within the passageway by placing said second container within said first container and pushing said second container into the passageway.

17. The apparatus of claim 11, wherein the surface of the passageway supports said second container.

18. The apparatus of claim 11, wherein the passageway extends inwardly with respect to a side of said neck.

19. The apparatus of claim 11, wherein said neck has a first width and said reservoir has a second width.

20. The apparatus of claim 19, wherein said first width is smaller than said second width.

* * * * *